United States Patent [19]

Mehl et al.

[11] 4,251,611

[45] Feb. 17, 1981

[54] PROCESS FOR FORMATION OF PERMANENT IMAGE

[75] Inventors: Wolfgang Mehl; Dieter Hendriks, both of Geneva; Robert Decombe, Ferney-Voltaire, all of Switzerland

[73] Assignee: Sublistatic Holding SA, Glaris, Switzerland

[21] Appl. No.: 880,902

[22] Filed: Feb. 24, 1978

Related U.S. Application Data

[63] Continuation of Ser. No. 539,934, Jan. 9, 1975, abandoned.

[30] Foreign Application Priority Data

Jan. 9, 1974 [CH] Switzerland ..... 00212/74

[51] Int. Cl.[3] ..... G03G 9/14; G03G 13/22

[52] U.S. Cl. ..... 430/42; 430/45; 430/47; 430/107; 430/111; 430/122; 8/471; 282/27.5

[58] Field of Search ..... 96/1.5, 1.6, 1.2; 430/42, 45, 47, 107, 111, 122

[56] References Cited

U.S. PATENT DOCUMENTS

| | | | |
|---|---|---|---|
| 3,767,578 | 10/1973 | Hagenbach et al. | 96/1 SD |
| 3,900,318 | 8/1975 | Zographos et al. | 96/1.2 |

FOREIGN PATENT DOCUMENTS

| | | | |
|---|---|---|---|
| 2500316 | 9/1974 | Fed. Rep. of Germany | 96/1.2 |
| 987767 | 3/1963 | United Kingdom | 96/1 R |

*Primary Examiner*—Edward C. Kimlin
*Assistant Examiner*—John L. Goodrow
*Attorney, Agent, or Firm*—Sprung, Felfe, Horn, Lynch & Kramer

[57] ABSTRACT

The present invention relates to electrophotography, and in particular to the formation of a permanent image in one or more colors from latent electrostatic images which correspond to the color separations of an original and the developing of which is effected by means of a developer composed of polymer particles containing at least one dyestuff which can sublime or vaporize at between 100° and 250° C. The recording is effected under dry conditions by vaporization or sublimation of the dyestuffs present in the developers, without any fixing operation following the transfer of the dyestuffs onto the support which receives the recording.

17 Claims, No Drawings

PROCESS FOR FORMATION OF PERMANENT IMAGE

This is a continuation of application Ser. No. 539,934, filed Jan. 9, 1975 now abandoned.

In conventional electrophotography, a photoconducting element is first charged uniformly and then exposed to a light image of the subject to be reproduced. This results in selective dissipation of the charge in the areas which the light strikes, and a latent image consisting of electrostatic charges is thus obtained. This image is generally made visible by being brought into contact with a finely divided electroscopic powder or developer. The areas possessing a high concentration of charge are developed with a high density of developer, whilst the areas which are more weakly charged possess a lower density of developer, after they have been developed. The powder images are then transferred onto a final support, for example paper, and are fixed thereon in order to form a permanent recording of the original.

It is possible to obtain coloured copies of a coloured original, by electrophotographic means. In fact, processes are known in which a charged photoconducting element, possessing panchromatic sensitivity, is exposed to a series of colour separations of an original, or to the original through a series of suitable chromatic filters. The latent electrostatic images thus obtained are then developed by means of developers of suitable colour and are transferred separately onto the copy support, the recomposition according to the original being effected automatically by superposing the powder images, successively transferred, and are then fixed on the copy support.

The process of the present invention no longer employs the transfer of powder images but rather the transfer to pure dyestuffs prevent in these images; the other constituents of the developers remain on the latent image. Consequently, when the images of different colours are being superposed on the receiving sheet, there is no longer any problem due to the opacity of the resin present in the developer or to the colouration of the ferromagnetic materials present in the developer, because the latter are not transferred. In three-or four-colour processes, optically very satisfactory mixing of the base colours is thus obtained.

This process permits the reproduction in colour of a coloured original by forming a permanent print of pure dye-stuffs, in particular by effecting simultaneously the operations of transferring and fixing an image of pure dyestuff, starting from a powder image. The advantages due to the rapidity with which such a process can be carried out and to the simplification of the equipment which results therefrom are immediately apparent. In effect, it suffices to heat the powder image which it is desired to record, in contact with a sheet which possesses affinity for the sublimable or vaporisable dyestuffs used. The use of copy supports possessing such affinity is an important characteristic of the present invention.

Another of the advantages provided by this procedure is as follows: since the transfer of the dyestuff no longer takes place grain by grain but rather in the form of dyestuff vapours, it is possible to adjust with precision the intensity of the dyestuff image transferred onto the receiving component, for example by varying the period of time for which and/or the temperature at which this operation is carried out. It thus becomes possible to equilibrate the optical densities of the images obtained from the different colour separations, without having to vary the exposure conditions or the concentration of dyestuff in the developers. Moreover, it may happen that the dye-stuff in the developer is not exhausted after the first transfer process; by adjusting the transfer conditions as well as the concentration of dyestuff in the developer, it is possible to make several copies from a single powder image.

Finally, since the polymer present in the developer is not necessarily fixed, it need not necessarily be thermoplastic; the choice of such a polymer is thus easier than in the conventional developing processes which require fixing; in these processes, it is necessary to establish a difficult compromise between the melting properties, the temperature at which the particles set solid and their capacity for becoming charged with triboelectricity.

A process for the formation of a multi-coloured image from latent images corresponding to the colour separations of an original, making use of sublimable or vaporisable dyestuffs, has been published in German Application No. 1,922,463. This is a purely thermographic process, in which there is a difference in the absorption of infra-red radiation between the image produced on an element with a photosensitive surface and the base. The thermo-images can be produced either directly by means of a change in the infra-red radiation absorption properties of the parts of the photosensitive surface which is exposed, or by developing the latent images by means of a developer which absorbs infra-red radiation more than does the base. In contrast to the present process, the dyestuffs are not applied in the developer but rather in a uniform coating produced on the surface, which is not intended to be exposed to light, of the photosensitive element. This process thus employs a special photosensitive element carrying, on the reverse side of the photosensitive surface, successive zones coated with the three base colours.

The subject of the present invention is thus a process for the formation of a permanent image in one or more colours starting from latent electrostatic images corresponding to the colour separations of an original, which are developed, preferably by the magnetic brush method, by means of a developer composed of polymer particles containing at least one dyestuff which can sublime or vaporise at between 100° and 250° C., characterised in that (a): the latent images are developed on a photoconducting element by means of a developer containing, in addition to the dyestuff, a ferromagnetic substance incorporated into the polymer particles, (b): each image thus developed is brought into contact with a receiving sheet which possesses affinity for the vapours of the sublimable or vaporisable dyestuff or dyestuffs of the developers, and (c); the whole is heated above the vaporization or sublimation temperature of the dyestuff or dyestuffs to be transferred, these operations being carried out in the case of each latent image, until the image to be reproduced has been racomposed.

The powder images at the start of the present process are developed by means of a dry developer, preferably in accordance with the so-called magnetic brush process, but any other developing process could be suitable.

If this developing method is used in conjunction with a new type of developer which is applicable to the magnetic brush and is described in U.S. patent application Ser. No. 524,339 filed Nov. 15, 1974, now abandoned in favor of continuation-in-part application Ser.

No. 843,085 filed Oct. 17, 1977 and, in turn, abandoned in favor of Ser. No. 17,774 filed Mar. 5, 1979, it makes it possible, in effect, to retain a constant proportion of dyestuff in the developer. These developers consist of particles comprising a ferromagnetic core coated with dyestuff dispersed in a polymer.

In contrast, the powder images which are generally produced by the conventional developing processes employing a magnetic brush consist of a coloured electroscopic resin and grains of magnetic carrier which remain held around the cylinder of the magnetic brush. The main disadvantage of the conventional processes is the fact that the dyestuff in the developer is gradually exhausted during the developing process; this leads to copies which become paler and paler. The consequences of this phenomenon are even more serious in colour reproduction because several developers of different colours are then used, since the gradual decrease in the optical density varies from one developer to another, there is not only a loss of intensity, but, since this loss of intensity varies from one colour to another, the final result is an incorrect reproduction of the colours. Amongst other disadvantages inherent in these developers, the following may be mentioned: in the case of some developers, the developer particles escape from the magnetic brush under the effect of the centrifugal force when they do not adhere sufficiently strongly to the magnetic carrier and lead to the formation of dust particles which have an adverse effect on the satisfactory operation of the machine. Other known developers adhere to the carrier so strongly that the force of electrostatic attraction of the latent image is insufficient to attract the particles onto the charge image, and a copy of poor quality is then obtained.

According to the present invention, the original to be reproduced is, for example, placed on a transparent plate which is positioned in a fixed manner in the lighting assembly. The optical system of the exposure station also comprises a mechanism of optical filters. The photoconducting element, chosen so as to give a panchromatic response to visible light, is first charged uniformly, for example by passing across a device which generates a corona effect adjusted to bring its surface to a relatively high potential. The photoconducting surface is then conveyed towards the exposure station where the light image of the original containing the input information is concentrated on it without distortion. During the exposure process, the separation filters are interposed in the optical trajectory of the objective. When the photoconducting surface is exposed to the light image, the surface is discharged in the regions which the light strikes, so that a latent electrostatic image remains which corresponds to the light image projected from the original. By effecting successive exposure through the separation filters, the chromatic composition of the original is recorded on the photoconducting element, the recordings corresponding to each separation being made on successive zones of this element, these zones being thereafter conveyed towards the developing station which comprises, for example, three or four developing devices for the purpose of applying developers of a different colour to each latent image to be developed.

The powder images obtained by developing the latent images are moved towards the transfer station where the dyestuff images which they contain are transferred, by heating, onto a receiving sheet. The movement of this receiving sheet is synchronised with that of the photoconducting element which carries the succession of powder images, and this makes it possible to superpose and align each of the images transferred on the sheet. When the last transfer operation has been carried out, the receiving sheet carrying the reproduction of the original is conveyed towards the copy collecting trough, because no fixing operation is necessary.

In the present process, the colours are reproduced by subtraction, that is to say the greens are produced by subtractive mixing of yellow and cyan (blue-green) in variable amount, the reds by mixing magenta and yellow, and the blues by mixing cyan and magenta. The latent image formed by exposure to the chromatic separation produced with a green filter will be developed using the magenta developer. Likewise, the blue separation will be developed using the yellow developer and the red separation using the cyanic developer.

The latent images are preferably developed by means of magnetic brushes arranged in series. What is involved is a known device which is described, for example, in U.S. Pat. No. 3,003,462 and which consists of a magnet surrounded by a metal cylinder. The developer particles become oriented along the lines of force of the magnetic field created by the magnet and thus form a sort of "brush", of which they will be the "bristles". This brush sweeps over the surface of the photoconducting element whilst the cylinders surrounding the magnets are rotated in order that they take up further fresh developer as it is consumed.

The developers used in the process of the present invention preferably possess a magnetic core firmly fixed to the coloured resin (electroscopic polymer). This is why, in contrast to the powder images which are generally obtained in the known developing processes employing a magnetic brush, those obtained in the present process also contain ferromagnetic substances. The use of such ferromagnetic developers, which consist of a single type of particle and which can be applied to the magnetic brush, is one of the important characteristics of the present invention.

Since the dyestuff present in the powder images is transferred onto a material which possesses affinity for it, it is not necessary to fix the image obtained. However, in some cases, it can be advantageous to fix the powder image before effecting transfer, for example by heating the image. In this case, the polymer coating the magnetic core must be chosen from amongst products which do not undergo change caused by heat, and resulting in that it shall retain the dyestuff on the photoconducting element and prevent it from being transferred onto the receiving sheet. Moreover, it must be possible to soften this polymer at a temperature which is still not high enough to cause the dyestuff to vaporise. However, in general terms, it is not necessary for the polymer to be thermoplastic; it must possess the least possible affinity for the dyestuffs used so that it does not retain them during the transfer process, and obviously it must have the necessary electroscopic properties.

Amongst the polymers which can be used, there may be mentioned ethylcelluloses or cellulose triacetate, polyamides and polystyrenes, epoxide resins, polyesters, some polycarbonates and, in particular, colophonium esters.

In the cases where the powder image was not fixed, it is possible to clean the surface of the photoconducting element for the purpose of using it again.

The nature of the receiving sheet varies in accordance with the chemical structure and with the sublimation range or the vaporisation temperature of the dyestuffs used. It can be a textile or non-textile material, a sheet of paper, a sheet of non-woven fabric or a sheet of synthetic paper, which is impregnated, covered or coated with or consists of acrylic polymers, polyamides or polyesters modified by means of acids, for example if the developing is effected using basic dyestuffs, or which is impregnated, covered or coated with or consists of polyesters, polyvinyl chlorides, epoxy resins or polystyrenes, or polyurethanes, if the developing is effected using developers containing disperse dyestuffs. In order to retain good definition of the reproduction obtained, it is necessary to avoid the presence of a plasticiser in the polymers of the receiving sheet (especially in the case of polyvinyl chloride), because the majority of plasticisers promote migration of the dyestuffs.

The dyestuffs which can sublime or vaporise at between 100° and 250° C., and which can be used according to the invention, can belong to the most diverse categories, such as organic pigments, that is to say dyestuffs which are insoluble both in an organic medium and in an aqueous medium, or disperse dyestuffs, dyestuffs which are soluble in organic solvents, or basic dyestuffs, classified respectively under the heading "disperse dyes", "solvent dyes" and "basic dyes" in the COLOUR INDEX edited by THE SOCIETY OF DYERS AND COLOURISTS, Dean House, Piccadilly, Bradford, Yorkshire, England.

The following dyestuffs may be mentioned, without this list implying a limitation:

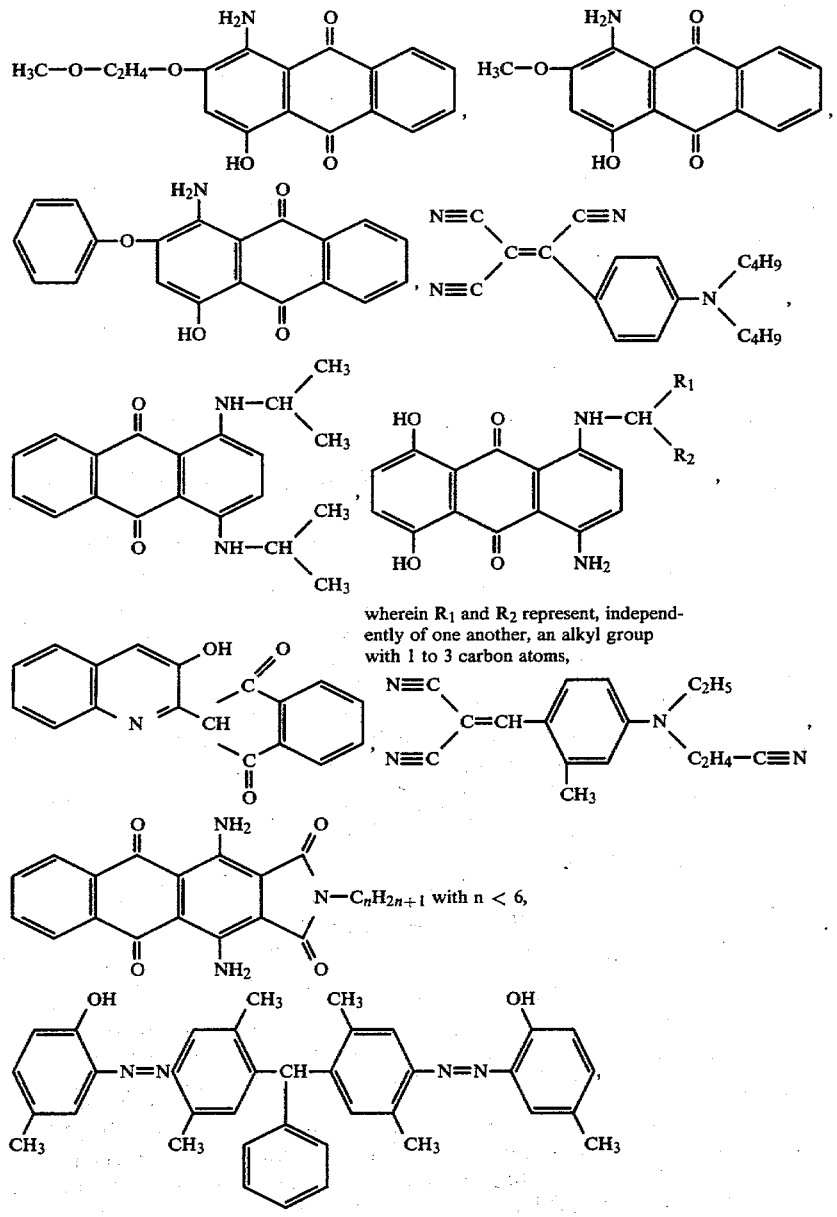

-continued

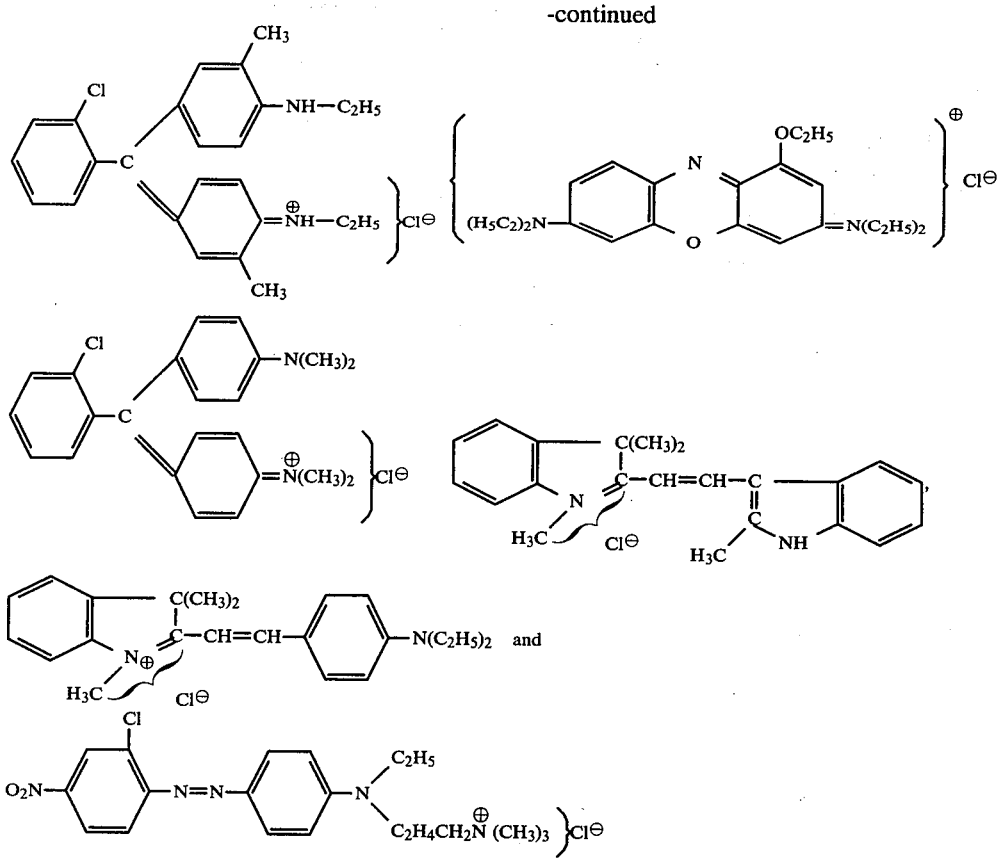

The present invention can be carried out in a great variety of electrostatic machines. The device necessary for effecting this process is a further subject of the present invention. It must comprise the following components: (a): an optical system capable of making the colour separations of an original to give light images corresponding to particular zones of the spectrum; (b): a charging station possessing a means for charging the surface of a photoconducting element uniformly, this means consisting preferably of a device which generates a corona effect extending from one edge to the other of the photoconducting element, and being adjusted to bring the surface of this element to a uniform charge potential; (c): an exposure station comprising in particular a means for exposing this charged surface to a selected light image; (d): a series of dry developing stations, consisting of magnetic brushes (preferably 4 stations, which correspond to developing processes employing a cyan, magenta, yellow and black developer); (e): a translation mechanism which brings one and the same sequence of the surface of the photoconducting element successively across the charging station, the exposure station, the developing station and the transfer station; and (f): finally, a transfer station which makes it possible to heat the image developed on the photoconducting element in contact with the receiving sheet, or an intermediate support, the movement of the latter being synchronised with that of the photoconducting element in order to make it possible to superpose and align each of the developed partial images.

The optical system (a) and the charging station (b) are of conventional type. The exposure station (c) can consist, for example, of a mobile objective (concentrating the light image on the photoconducting element) and a mechanism which makes it possible successively to interpose chromatic separation filters, these filters travelling with the objective, in a simultaneous action, during the optical scanning of the original. The latter can, for example, be kept fixed on a transparent sighting plate, illuminated, for example, by a lamp or some other light-generating luminous source. The magnetic brushes of the developing station (d) have been described above.

The device used in the invention can also comprise a preheating system placed on the path of the photoconducting element between the developing station and the transfer station, making it possible to fix the developed image before transferring the dyestuff image which it contains. After the transfer station, it is also possible to have a cleaning system and optionally a system for recovering spent developers.

During the developing process, the space between the partial latent images can be controlled by means of a logic system, in order to actuate the corresponding developing device. The photoconducting element can be made to travel past and the optical system can be aligned by means of any suitable mechanical or optical means, such as the combination of cogwheels and a perforated photoconducting belt. The transfer operation and, where appropriate, the preliminary heating operation can be effected by passing the photoconducting element over a system of heated plates. The receiving sheet can, for example, be held in position by suction. A cleaning station can comprise, for example, a rotary brush adjusted so as to remove the particles comprising a ferromagnetic core coated with polymer.

The devices of the type described above obviously make it possible to obtain a coloured reproduction of a coloured original but they also make it possible to obtain a reproduction in black and white, for example, from a black or coloured original.

The black developer can be produced from a mixture of at least two dyestuffs which possess very similar sublimation or vaporisation curves, for example a mixture of the following violet dyestuff and orange dyestuff:

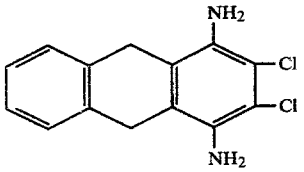

(violet) and

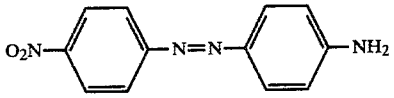

(orange)

In the following non-limiting examples which illustrate the present invention, the parts and percentages are expressed by weight, unless otherwise indicated, and the temperatures are expressed in degrees Centigrade.

EXAMPLE

Employing an objective of the RODAGON type supplied by Messrs. RODENSTOCK, the minimum aperture of which is 1:5.6 and the focal distance of which is 210 mm, an A4 size image is reproduced on a sheet of electrophotographic paper containing zinc oxide. The light source consists of two OSRAM halogen lamps of the 057,71 B type, 220 volts, each of 1,000 watts. Before exposure, the zinc oxide paper was charged electrostatically to 600 volts in an ELFASOL $^{R}$ corona-effect charger of the type AG 612.

The red, green and blue separation of the image to be reproduced are separated successively from the light beam, in the vicinity of the objective lens; the selection is made by means of "GRAPHIC SPECIAL" filters supplied by AGFA-GEVAERT, of the L 599 C type (red), the U 525 C type (green) and the U 438 C type (blue). The following exposure times are used in the process:

1.0 second through the red filter,
4.0 seconds through the green filter, and
9.0 seconds through the blue filter.

Each of the electrostatic latent images is then developed using a magnetic brush travelling over the electrophotographic paper at the rate of 50 mm per second. The distance between the zinc oxide paper and the outer cylinder of the magnetic brush is 0.7 mm. The thickness of the layer of developer present on the cylinder of the magnetic brush is 0.9 mm. The latter is made of aluminium and its external diameter is 33 mm. The inside of the cylinder contains a cylindrical core also made of aluminium, inside which there are fixed 8 rows of "ferroxydur" magnets of the 8222 290 01561 type supplied by Messrs. PHILIPS. The outside of the magnet is 0.7 mm from the inside of the outer cylinder, the thickness of which is 0.5 mm. The core of the magnetic brush is rotated at 300 revolutions per minute by means of a motor supplied by alternating current.

The developers were prepared as described in the U.S. patent application Ser. No. 524,339 filed Nov. 15, 1974, now abandoned in favor of continuation-in-part application Ser. No. 843,085 filed Oct. 17, 1977 and, in turn, abandoned in favor of Ser. No. 17,774 filed Mar. 5, 1979. The electrostatic field of the latent image is stronger, in a proportion which varies with the charge which remains on the zinc oxide paper after exposure, than the magnetic field holding the particles of developer on the magnetic brush, so that the particles of developer are deposited on the paper at the corresponding places, and consequently the latent image is developed.

After the developing process, the polymeric constituent of the developer is fixed on the zinc oxide paper by a 5 second treatment at 150° C. under a pressure of 500 g/cm$^2$. The developers contained the following dyestuffs:

yellow dyestuff

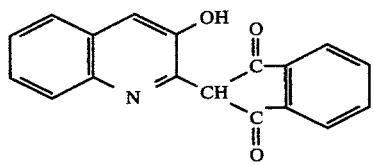

red dyestuff

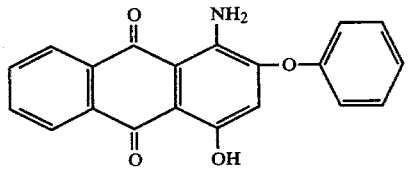

blue dyestuff

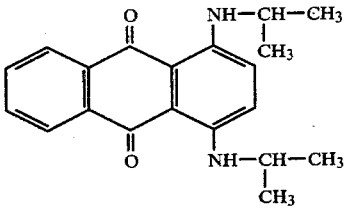

or

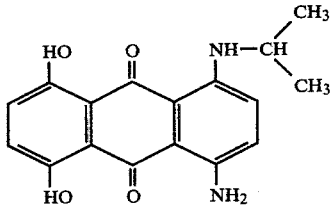

The three powder images produced and fixed on the zinc oxide paper are then brought into contact, one after the other, with a receiving sheet; these operations are carried out in order, at the temperatures and for the periods indicated below, contact being maintained by a pressure of 100 g/cm$^2$:

cyan 200° C. 10 seconds
magenta 200° C. 10 seconds
yellow 200° C. 10 seconds

The majority of the dyestuffs present in the developers is thus transferred and fixed simultaneously on the receiving sheet. The alignment of the three images superposed in this way is controlled by means of registering marks. The original is thus reproduced in three colours.

The receiving sheet was prepared in the following way: a sheet of SYNTOSIL ® synthetic paper supplied by ZUERCHER PAPIERFABRIK AN DER SIHL is coated with a dispersion containing 10% of styrene, 5% of AEROSIL ® $SiO_2$ supplied by DEGUSSA, Frankfurt, and 10% of ETHOCEL ® supplied by DOW CHEMICALS CO., in a mixture comprising 50% of methyl ethyl ketone per 50% of ethanol. After a drying period of 30 seconds, the sheet of paper thus prepared can be used as a copy receiving sheet in the process described above.

The receiving sheet can also consist of a sheet of paper coated with a glossy film based on polystyrene. This film is produced in the following way: 20 parts of polystyrene are stirred in xylene at 80° C. until complete dissolution has taken place. A layer of this solution is applied to the sheet of paper; after drying, the sheet is ready to receive the dyestuff images. Likewise, a matt polystyrene film can be applied to the receiving sheet; it suffices to add 2.5 parts of a urea/formaldehyde resin to the above preparation.

The polystyrene can be replaced by an epoxy resin. Thus, copies of good intensity are obtained on sheets of paper coated with a layer of the following preparation: 30 parts of ARALDITE ® 488 N 40 (CIBA-GEIGY), 5 parts of LYOFIX CH ® (CIBA-GEIGY) and 0.5 part of UVITEX ® SOP (CIBA-GEIGY) as well as 0.5 part of ethylcellulose ETHOCEL N22 supplied by DOW CHEMICAL CORP. are stirred in methyl ethyl ketone. After drying, a smooth and glossy covering is obtained. If, on the other hand, a matt covering is desired, it suffices to add 1% of silica gel CAB-O-SIL ® (CABOT CORP.) to the above preparation and to coat the paper with two successive layers.

Very satisfactory results are also obtained on papers covered with one of the following dispersions: 10 parts of RHODOPAS AXCM-3 ® (a copolymer of vinyl chloride and vinyl acetate with maleic acid) and 50 parts of ethylcellulose ETHOCEL N22 supplied by DOW CHEMICAL CORP. are stirred in methyl ethyl ketone, or alternatively, 5% of AEROSIL ® $SiO_2$ supplied by DEGUSSA, Frankfurt, and 10% of ETHOCEL ® supplied by DOW CHEMICALS CO. are stirred in a mixture comprising 50% of methyl ethyl ketone per 50% of ethanol.

We claim:

1. Process for the formulation of a permanent image in one or more colors starting from latent electrostatic images corresponding to the color separations of an original, characterized in that (a) The latent electrostatic images are developed by the magnetic brush method, by means of a developer consisting of ferromagnetic cores and representing at least 50% of the weight of the developer particle embedded in a colored resin, devoid of wax, containing more than 10% of at least one dyestuff which can sublime or vaporize at between 100° and 250° C., at atmospheric pressure and is a monoazo, anthraquinone, quinophthalone or styryl dyestuff and wherein the particles are spherical and sphere-like shaped and have an average diameter of from 1 to 30 microns, (b) said developer is fixed on a photoconducting surface by heat and/or pressing before the dyestuff is transferred onto a receiving sheet (c) each image thus developed is brought into contact with a receiving surface which possesses affinity for the vapor of the sublimable or vaporizable dyestuff or dyestuffs of said developers, and (d) the resulting material is heated above the vaporization or sublimation temperature of the dyestuff or dyestuffs to be transferred, these operations being carried out in the case of each latent image, until the image to be reproduced has been recomposed.

2. Process according to claim 1, characterised in that the particles of developer are fixed by preheating at a temperature below that required to transfer the dyestuff.

3. Process according to claim 1, characterised in that the particles of developer consist of a ferromagnetic core coated with coloured polymer.

4. Process according to claim 1, characterised in that the particles of developer contain a polymer which melts at a higher temperature than that required to transfer the dyestuff.

5. Process according to claim 1, characterised in that the particles of developer contain a polymer which has little or no affinity for the dyestuff.

6. Process according to claim 1, characterised in that the particles of developer contain a disperse dyestuff which is transferred onto a receiving sheet consisting of or covered, coated or impregnated with polyester, polyamide, unplasticised polyvinyl chloride, epoxide resins, polystyrene, polyurethane, cellulose polyacetate or one of their copolymer (sic).

7. Process according to claim 1, characterized in that the particles of developer contain a modified basic dyestuff which is transferred onto a receiving sheet consisting of or covered, coated or impregnated with polyacrylonitrile, polyester or polyamide modified by means of acids.

8. Process according to claim 1, characterised in that the particles of developer contain at least one of the following dyestuffs:

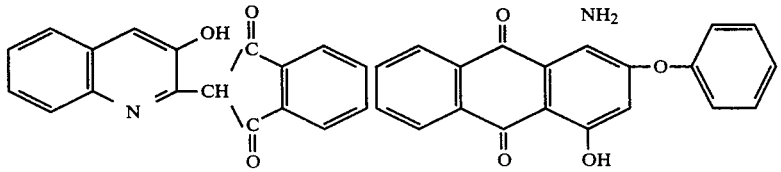

-continued

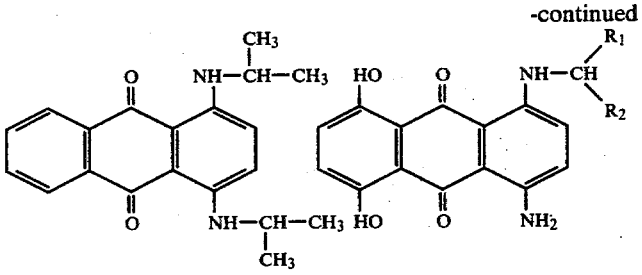

wherein $R_1$ and $R_2$ represent, independently of one another, an alkyl group with 1 to 3 carbon atoms.

9. Process according to claim 1, characterised in that the particles of developer contain at least one of the following dyestuffs:

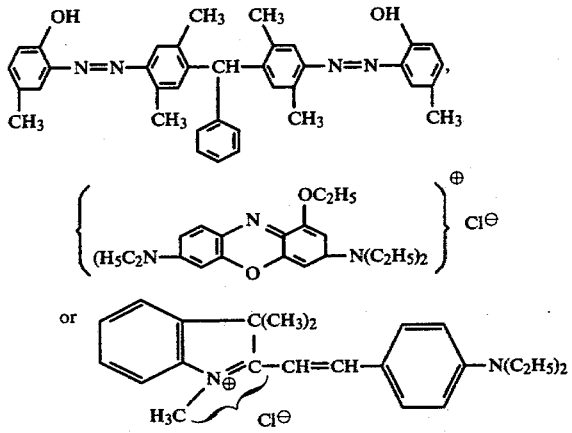

10. Process according to claim 1, characterised in that the receiving surface consists of a synthetic paper carrying a layer of ethylcellulose containing $SiO_2$.

11. Process according to claim 1, characterised in that the receiving surface consists of a textile material.

12. Process according to claim 1, characterised in that firstly a cyan image and then a magenta image followed by the yellow image are transferred onto the receiving surface.

13. Process according to claim 13, characterised in that a black image is also transferred onto the receiving surface.

14. Process according to claim 1, characterised in that the photoconducting element is not cleaned for the purpose of using it again.

15. Process according to claim 1, characterised in that a black developer is used.

16. Device for forming a permanent image according to the process defined in claim 1, characterised in that it comprises means which make it possible uniformly to charge a given surface of a photoconducting belt, then to expose it to a succession of light images produced by chromatic selection of an original, then to develop each latent image thus obtained by means of magnetic brushes used in conjunction with dry developers of suitable colour, and finally to heat the images thus developed, one by one, in contact with a receiving sheet whilst ensuring that the image to be reproduced is recomposed by superposing and aligning the dyestuff images transferred in succession.

17. Device according to claim 16, characterised in that it comprises a preheating system which is placed on the path of the photoconducting element before it passes to the transfer station, and which is adjusted to a temperature such that this element is raised to a temperature below the vaporisation or sublimation temperature of the dyestuffs to be transferred.

* * * * *